US007101207B1

(12) United States Patent
Chi-Te

(10) Patent No.: US 7,101,207 B1
(45) Date of Patent: Sep. 5, 2006

(54) MEMORY CARD CONNECTOR

(75) Inventor: Kuan Chi-Te, Shulin (TW)

(73) Assignee: L&K Precision Technology Co., Ltd., Taipei Hsien (TW)

( * ) Notice: Subject to any disclaimer, the term of this patent is extended or adjusted under 35 U.S.C. 154(b) by 0 days.

(21) Appl. No.: 11/139,469

(22) Filed: May 31, 2005

(51) Int. Cl.
*H01R 29/00* (2006.01)

(52) U.S. Cl. ..... 439/188; 439/923; 439/636; 439/159

(58) Field of Classification Search ..... 439/188, 439/923, 636, 159
See application file for complete search history.

(56) References Cited

U.S. PATENT DOCUMENTS 6,478,595 B1 * 11/2002 Nishioka ..... 439/188
6,863,570 B1 * 3/2005 Chen ..... 439/630

* cited by examiner

*Primary Examiner*—Truc Nguyen
(74) *Attorney, Agent, or Firm*—Troxell Law Office, PLLC

(57) ABSTRACT

A memory card connector has an insulative frame, a plurality of conductive terminals received in the insulative frame, an ejecting device for guiding a memory card in or out, a shell shielding the insulative frame, and an activation switch. The conductive terminals have at least two power terminals for power supply. Each power terminal has double springy connecting points and a channel between the two connecting points, whereby the two connecting points are apart from each other for engaging contacting points of the memory card firmly. The activation switch is normal-closed type and includes a switch base, a bias strip integrally stamped from an end of the switch base, and an interferential strip at another end of the switch base. The bias strip is substantially inclined upwardly and has a guiding portion, a connecting portion, and a bending portion for providing a certain resiliency.

9 Claims, 3 Drawing Sheets

MEMORY CARD CONNECTOR

BACKGROUND OF THE INVENTION

1. Field of the Invention

The present invention relates to a memory card connector, and particularly to a Push—Push Type memory card connector which has a normal-closed switch and double springy connecting points for power supply thereby insuring stable data transmission.

2. Related Art

Push—Push Type memory card connectors allow a memory card being inserted in or ejected out by pressing the memory card and are popularly used in digital cameral, mobile phone, and Personal Digital Assistant. These memory card connectors often have a small profile and short card insertion distance. Therefore it is uneasy to determine whether the memory card is positioned. In the case that the memory card does not reach a prescribed position, a user performs data transmission of the card, tending to damage the card or to transmit data unstably due to improper contact.

Moreover, the memory card connectors often contact the card in horizontal direction. Namely, conductive terminals of such a memory card connector have suspending structure and engage contacting points of the memory card inserted horizontally. Manufacture tolerance often makes improper contact between the contacting points of the memory card and the conductive terminals. Especially, once some conductive terminals for power supply do not contact the corresponding contacting points exactly, the data transmission is apt to be unstable.

SUMMARY OF THE INVENTION

Accordingly, an object of the present invention is to provide a memory card connector which assures to engage a memory card in the case of reaching a prescribed position and has power terminals with double springy connecting points to firmly engage contact points of the memory card.

The card connector comprises an insulative frame, a plurality of conductive terminals received in the insulative frame, an ejecting device for guiding a memory card in or out, a shell shielding the insulative frame, and an activation switch. The conductive terminals have at least two power terminals for power supply. Each power terminal has double springy connecting points and a channel between the two connecting points, whereby the two connecting points are apart from each other for engaging contacting points of the memory card firmly.

The activation switch is normal-closed type and includes a switch base, a bias strip integrally stamped from an end of the switch base, and an interferential strip at another end of the switch base. The bias strip is substantially inclined upwardly and has a guiding portion, a connecting portion, and a bending portion for providing a certain resiliency.

DESCRIPTION OF THE PREFERRED EMBODIMENTS

Figure 1:
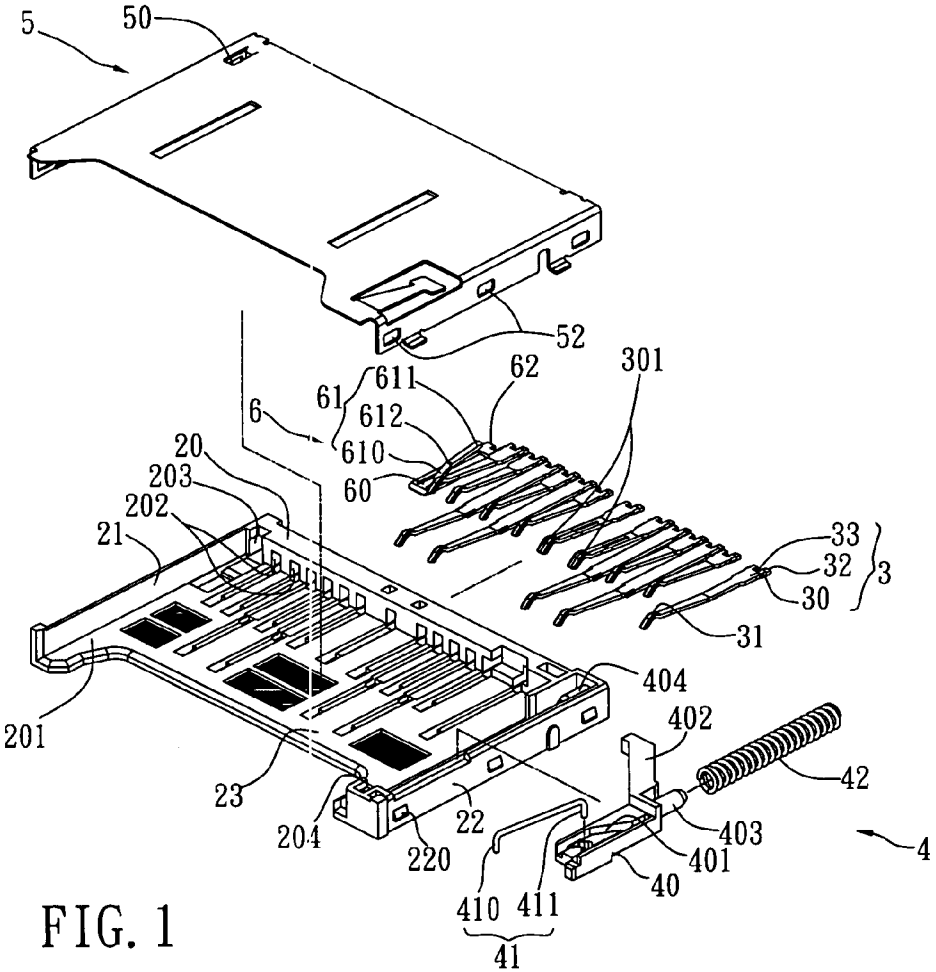
FIG. 1 is an exploded view of a memory card connector of the present invention.
Figure 2:
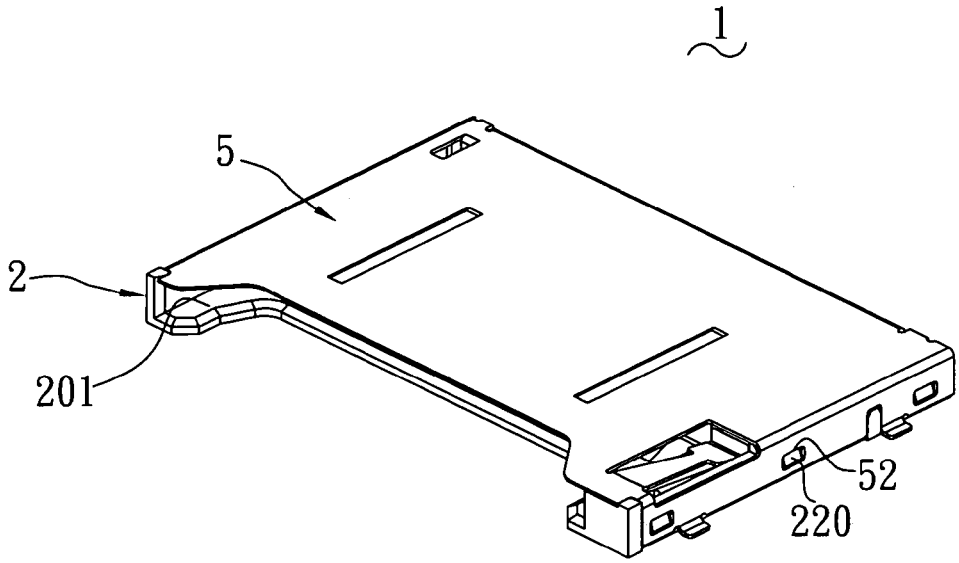
FIG. 2 is an assembled view of the memory card connector of FIG. 1.
Figure 3:
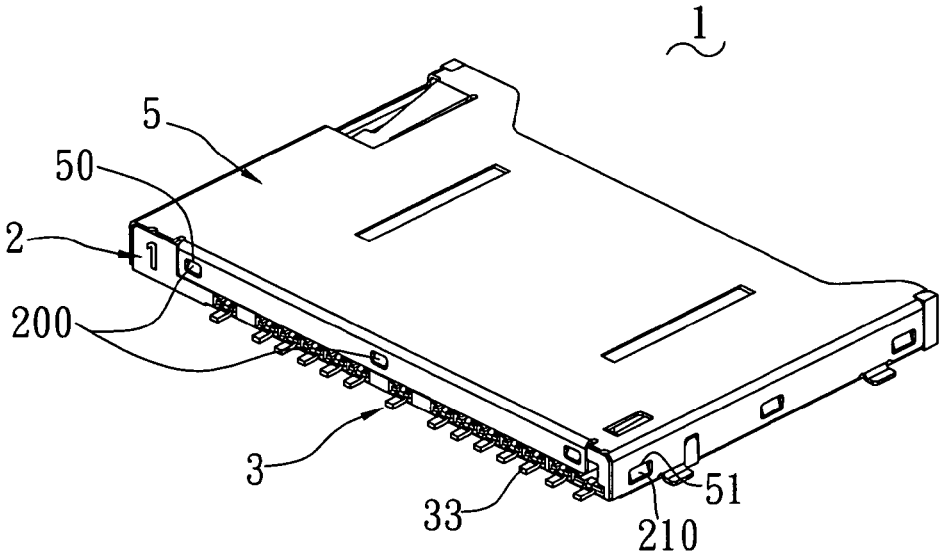
FIG. 3 is an assembled view of the memory card connector from another aspect.
Figure 6:
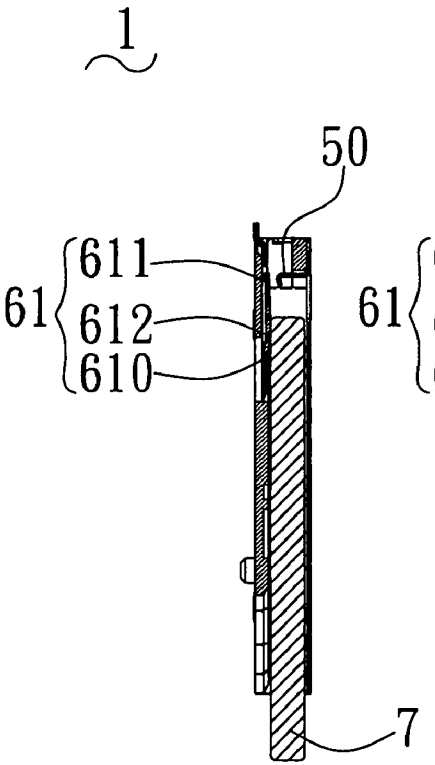
FIG. 6 shows a memory card being inserted in the memory card connector of the present invention.
Figure 4:
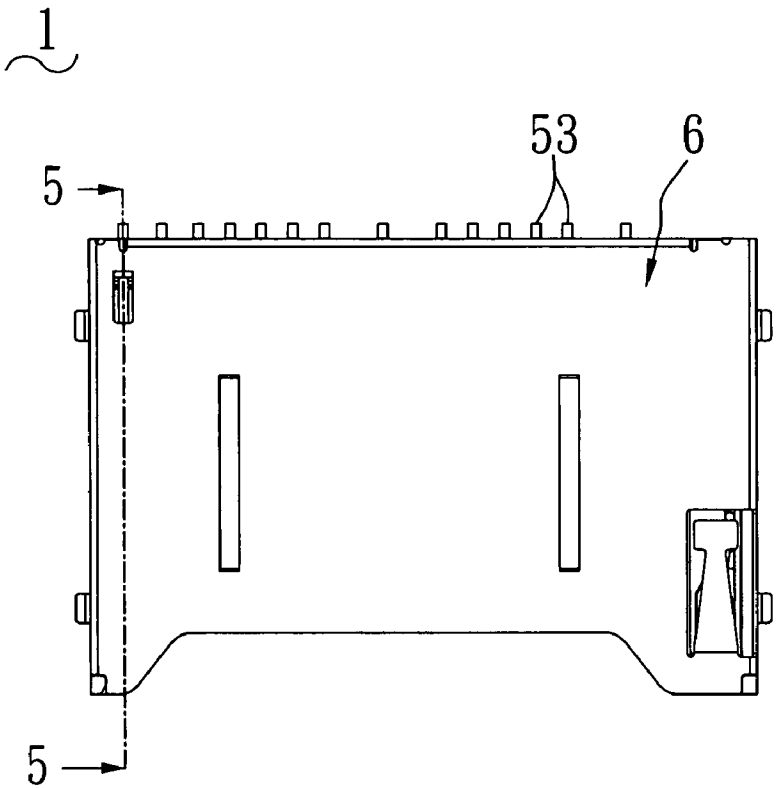
FIG. 4 is a top view of the memory card connector of FIG. 2.

With reference to FIGS. 1 through 3, a memory card connector 1 of the present invention comprises an insulative frame 2, a plurality of conductive terminals 3 received in the insulative frame 2, an ejecting device 4, a shell 5 and an activation switch 6. The insulative frame 2 has a housing 20, a first side wall 21 and a second side wall 22 respectively extending from opposite ends of the housing 20, and a bottom wall 23 extending from a bottom edge of the housing 20. The housing 20, the first and the second side walls 21, 22 and the bottom wall 23 define a slot 201 together for receiving a memory card 7 (shown in FIG. 6) therein. The housing 20 defines a plurality of passageways 202 for receiving the conductive terminals 3. Combining FIGS. 1, 2 and 3, tabs 200, 210, 220 are respectively formed on the housing 20 and the first and the second side walls 21, 22 for locking the shell 5. An assembling hole 203 is formed on the housing 20 and adjacent the passageways 202 for accommodating the ejecting device 4. An axis base 204 is formed on an end of the second side wall 22.

The conductive terminals 3 are suspending and assembled on the passageways 202. Each conductive terminal 3 includes a body 30, a contact end 31 extending from an end of the body 30, an interferential portion 32 and a soldering end 33 opposite the contact end 31. The conductive terminals 3 have at least two power terminals. The power terminals are arranged in location substantially at middle of the conductive terminals 3. The power terminals have bifurcated contact ends. Each power terminal has double springy connecting points at the contact end for engaging contacting points of the memory card 7. Each power terminal has a channel 301 at the contact end thereof and between the two connecting points, whereby the two connecting points of the power terminal are apart from each other for double contacting the memory card 7 resiliently and reliably. The contact end 31 of each conductive terminal 3 has an arc at a front end thereof for facilitating engaging a contacting point of a memory card. The interferential portion 32 has barbs depending from opposite sides of the body 30 for interferentially fitting to an inner wall of a passageway 202. The soldering end 33 extends and bends from the body 30 for surface mounting.

The ejecting device 4 is mounted on the second side wall 22 of the insulative frame 2 and opposite the assembling hole 203, and includes a sliding base 40 and a guiding pole 41. The sliding base 40 defines a heart-like guiding groove 401 therein for guiding the memory card 7 in or out. A link arm 402 is slantwise formed at a side of the sliding base 40 and near the guiding groove 401. A shoulder 403 is formed on the sliding base 40, and a positioning post 404 is formed in the second side wall 22 and opposing to the assembling groove 203. The guiding pole 41 has a pivoting end 410 pivoting to the axis base 204 of the second side wall 22, and a moving end 411 opposite the pivoting end 410 for moving along the guiding groove 401. A resilient element 42, for example a compressed spring, abuts against the sliding base 40, and has an end mounted on the shoulder 403, and another end mounted on the positioning post 404, thereby providing returning force for the sliding base 40.

The activation switch 6 is assembled on the assembling block 203 in assembly and is normal-closed type. The activation switch 6 has a generally rectangular switch base 60, a generally rectangular bias strip 61 integrally stamped from an end of the switch base 60, and an interferential strip 62 formed at another end of the switch base 60. The bias strip 61 is substantially inclined upwardly and includes a guiding portion 610, a connecting portion 611, and a bending portion 612 for providing a certain resiliency.

Figure 5:
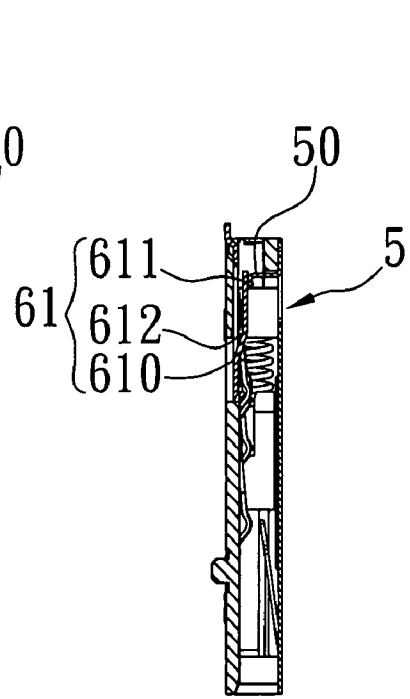
FIG. 5 is a sectional view of the memory card connector taken along the line 5—5 of FIG. 4.

The shell 5 is mounted on the insulative frame 2 and shields the housing 20, the first and the second side walls 21, 22. A bias arm 50 is integrally stamped inwardly from the shell 5 for engaging the connecting portion 611 of the bias strip 61, as shown in FIG. 5. Referring to FIGS. 2 and 3, locking holes 50, 51, 52 are defined in the shell 5 for respectively locking with the tabs 200, 210, 220 of the insulative frame 2, thereby fixing the shell 5 on the insulative frame 2.

The activation switch 6 is normal-closed. Further referring to FIG. 6, the memory card 7 is inserted into the memory card connector 1 along the guiding portion 610 of the bias strip 61. Along with extension of, the connecting portion 611 is pressed downward until the connecting portion 611 disengages from the bias arm 50 of the shell 5 and the memory card 7 reaches a prescribed position. Meanwhile power is set on. Further referring to FIG. 1, each power terminal has double springy connecting points apart from each other. The two power terminals respectively contact the memory card 7 with double springy connecting points, which assures the power terminals firmly contacting the memory card 7 even under unfavorable environment, for instance, vibration or incorrect insertion.

It is understood that the invention may be embodied in other forms without departing from the spirit thereof. Thus, the present examples and embodiments are to be considered in all respects as illustrative and not restrictive, and the invention is not to be limited to the details given herein.

The invention claimed is:

1. A memory card connector for transmitting data between a memory card and a circuit board comprising:

a) an insulative frame having:

i) a housing having a plurality of passageways and an assembling hole located adjacent to the plurality of passageways;

ii) a first side wall;

iii) a second side wall;

iv) a bottom wall; and v) a slot defined by the housing the first side wall, the second side wall, and the bottom wall, the memory card being slidable inserted into the slot;

b) a plurality of conductive terminals located in the slot; each of the plurality of conductive terminals has a body, a contact end, an interferential portion, and a soldering end, the plurality of conductive terminals includes at least two power terminals for power supply, each of the at least two power terminals includes two connecting points and a channel located between the two connecting points, the two connecting points are springy and engage contacting points of the memory card, the two connecting points are spaced apart;

c) an ejecting device mounted on a side of the insulative frame and having:

i) a sliding base having a guiding groove guiding the memory card in and out of the slot and a link arm formed adjacent the guiding groove;

ii) a guiding pole having a pivoting end and a moving end located on an end opposite the pivoting end, the pivoting end is pivotally connected to the second side wall, the moving end moving along the guiding groove; and iii) a resilient element biasing the sliding base away from and end of the second side wall;

d) an activation switch located in the assembling hole of the insulative frame and being movable between open and closed positions, the activation switch is normally in the closed position and having:

i) a switch base;

ii) a bias strip integrally stamped in a first end of the switch base, the bias strip inclining upwardly and having a guiding portion, a connecting portion, and a bending portion; and iii) an interferential strip formed at a second end of the switch base opposite the first end; and e) a shell fixed on the insulative frame and shielding the housing, the shell having a first shell side wall, a second shell side wall, and a bias arm integrally stamped therefrom, the bias arm engaging the connecting portion of the activation switch when the activation switch is located in the closed position.

2. The memory card connector according to claim 1, wherein the link arm is formed at a side of the sliding base.

3. The memory card connector according to claim 1, wherein the resilient element is a compression spring abutting the sliding base.

4. The memory card connector according to claim 1, wherein the sliding base has a shoulder, the second side wall has a positioning post located on an end of the housing opposite the assembling hole, the resilient element has a first end located on the shoulder and a second end located on the positioning post.

5. The memory card connector according to claim 1, wherein the housing has a plurality of tabs located on the housing, the first side wall and the second side well, the shell has a plurality of locking holes, one of the plurality of tabs is inserted into each of the plurality of locking holes.

6. The memory card connector according to claim 1, wherein the at least two power terminals are located at a middle portion of the plurality of conductive terminals.

7. The memory card connector according to claim 1, wherein each contact end of each of the plurality of conductive terminals has an arc located at a front end thereof for engaging one of the contacting points of the memory card, each interferential portion of each of the plurality of conductive terminals has barbs engaging an inner wall of each of the plurality of passageways, and each soldering end of each of the plurality of conductive terminals extends from the body thereof.

8. The memory card connector according to claim 1, wherein each of the switch base and the bias strip of the activation switch has a rectangular shape.

9. The memory card connector according to claim 1, wherein the guiding groove of the sliding base has a heart shape.

* * * * *